United States Patent [19]

Gollasch et al.

[11] Patent Number: 5,060,813

[45] Date of Patent: Oct. 29, 1991

[54] CONTAINER WITH A SCREW-CAP CLOSURE

[75] Inventors: Albert Gollasch, Kuerten-Weiden; Johannes Engst, Leverkusen, both of Fed. Rep. of Germany

[73] Assignee: Bayer Aktiengesellschaft, Leverkusen, Fed. Rep. of Germany

[21] Appl. No.: 577,722

[22] Filed: Sep. 5, 1990

[30] Foreign Application Priority Data

Sep. 13, 1989 [DE] Fed. Rep. of Germany ..... 3930519

[51] Int. Cl.[5] ..... B65D 41/28

[52] U.S. Cl. ..... 215/329; 215/352; 215/354

[58] Field of Search ..... 215/352, 329, 341, 343, 215/344, 351, 354; 220/358, 357

[56] References Cited

U.S. PATENT DOCUMENTS

| | | | |
|---|---|---|---|
| 1,516,129 | 11/1924 | Wiking | 215/352 |
| 3,480,169 | 11/1969 | Hammes | 215/352 |
| 3,677,430 | 7/1972 | Yates, Jr. | 215/352 |
| 4,346,812 | 8/1982 | Banich, Sr. | 215/352 |
| 4,823,970 | 4/1989 | Young | 215/352 |
| 4,844,273 | 7/1989 | Hawkins | 215/352 |
| 4,896,782 | 1/1990 | Hawkins et al. | 215/352 |
| 4,971,774 | 11/1990 | Schwanke et al. | 220/358 |

FOREIGN PATENT DOCUMENTS

| | | | |
|---|---|---|---|
| 1497255 | 1/1978 | United Kingdom | 215/352 |

*Primary Examiner*—Stephen Marcus
*Assistant Examiner*—Paul A. Schwarz
*Attorney, Agent, or Firm*—Sprung Horn Kramer & Woods

[57] ABSTRACT

In containers (1( with a screw cap closure (2), both of plastic, the sealing and the firm fit of the screw-cap (2) are improved, in the event of the container dropping, by virtue of the fact that a conical sealing ring (10), which presses from the inside against the mouth rim (5) of the pouring spout (3), is combined with an O-ring seal (13), which is inserted in an undercut annular groove (11) sunk in the end face (6) of the screw-cap closure (2) between the conical sealing ring (10) and the peripheral wall (7), and that in the closed condition the mouth rim (5) bears tight against the peripheral wall (7).

3 Claims, 1 Drawing Sheet

CONTAINER WITH A SCREW-CAP CLOSURE

BACKGROUND OF THE INVENTION

The invention relates to a container with a screw-cap closure, both of plastic, the screw-cap closure having a conical sealing ring which, in the closed condition, presses sealingly from the inside against the mouth rim of the pouring spout.

Containers of this type, such as bottles, canisters, cans, drums, are frequently used for highly concentrated liquid or pasty chemicals, for example for plant protection agents.

The mouth rim of the pouring spout has hitherto additionally been sealed after filling by means of a foil, in order to ensure absolute leakproofness at least until the first opening and removal of the contents. If, for example, spraying devices are connected directly onto the pouring spout, then the sealing foil must be completely removed. It is in most cases contaminated with the chemical, and its disposal is problematic. The mouth edge of the pouring spout of such containers required a mechanical aftertreatment, so that the foil could also be welded on really absolutely sealingly. After detaching or puncturing the sealing foil, the function of the latter was lost, and there was no longer a leakproof seal. Apart from sealing, conical seals, cup seals and sealing inserts of rubber or other flexible materials are known. All these design forms are limited in their application. In particular, rubber seals swell up under the action of various chemicals and in this way lose their sealing effect. If a sealed container drops from some height, there is a risk of the screw-cap closure breaking off or of the container mouth leaking as a result of deformation.

SUMMARY OF THE INVENTION

The object is to improve a container with a screw-cap closure so that a leakproof and drop-proof closure is guaranteed even without a sealing foil.

This object is achieved by virtue of the fact that an annular groove is sunk on the inside of the end face of the screw-cap closure between the conical sealing ring and the peripheral wall, the opening of which annular groove is narrower than its width, an elastomeric O-ring being arranged in this annular groove, and that, in the closed condition, the mouth rim bears tight on the peripheral wall.

The leakproof fit between the conical sealing ring and the mouth rim of the pouring spout means that the O-ring seal is to a large extent protected from the vessel contents, so that the risk of swelling is substantially reduced. The O-ring seal primarily effects sealing against the escape of vapours, and in the case where, for production engineering or other reasons, the leakproof fit previously arranged between the conical sealing ring and the mouth rim of the pouring spout provides insufficient sealing, it assumes, as it were, the function of a back-up seal. However, should the O-ring swell, then, as a result of its positioning in an undercut annular groove, it can only expand through the narrow opening in the direction of the end face of the mouth rim of the pouring spout, and in this way strengthens the sealing effect. In the event of the container falling, the special dimensioning of the wall of the mouth rim, namely the fact that this in the closed condition, under the pressure exerted by the conical ring seal, bears tight on the inside of the peripheral wall of the closure cap, prevents the mouth from being deformed or the cap from breaking off. Such vessels satisfy the approval requirement, namely that the closure cap must remain fixed and leakproof in the event of the vessel falling from, for example, a height of 1.50 m. A sealing foil, with all its disadvantages, is therefore unnecessary. However, the mouth rim should under no circumstances exert considerable pressure on the peripheral wall, since otherwise difficulties may occur on unscrewing the closure cap.

In an equivalent embodiment, the screw-cap closure has an end section which is plane on the inside, and the conical ring seal and annular groove with O-ring are arranged on/in an insertion piece.

In the drawing, the novel container is shown purely diagrammatically in one embodiment and is described in greater detail below. In the drawing:

DETAILED DESCRIPTION OF THE INVENTION

Figure 1:
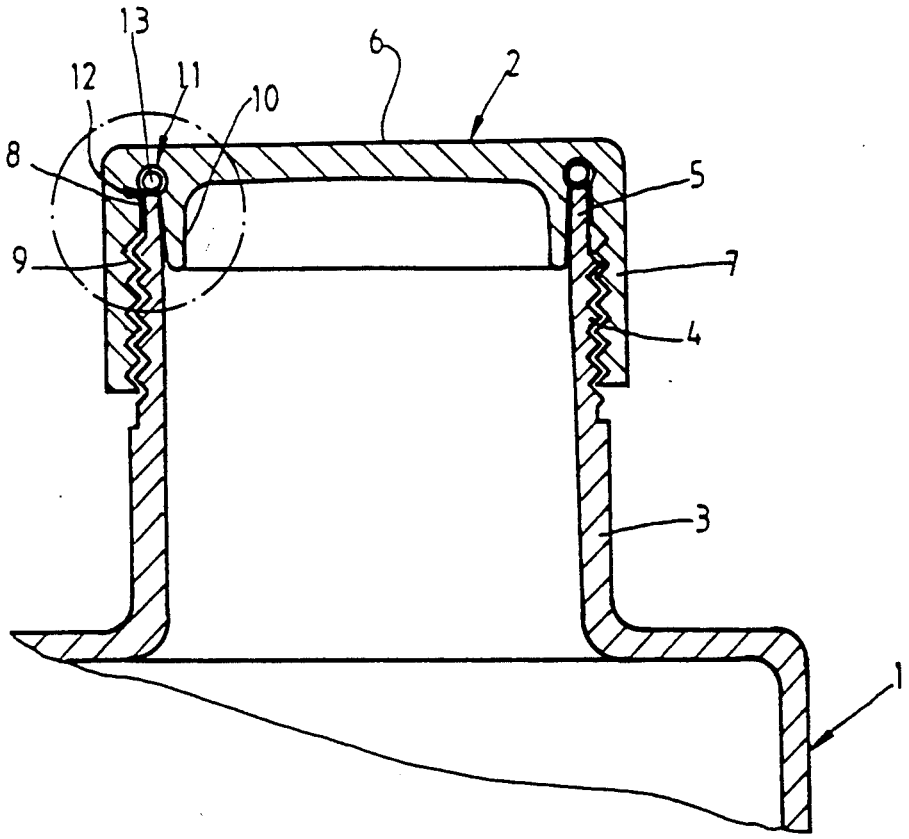
FIG. 1 shows the container in a cutaway view.
Figure 2:
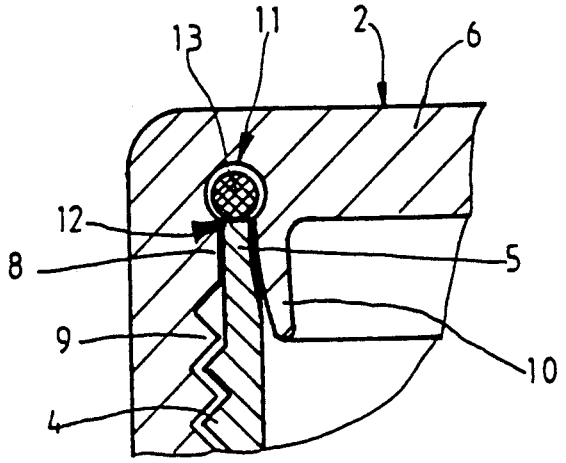
FIG. 2 shows the detail A on an enlarged scale.

The container is designated by 1 and the screwcap closure by 2. They are produced from plastic by the injection moulding process. The container 1 is provided with a pouring spout 3 which has an external thread 4. The actual mouth rim 5 of this pouring spout 3 has no thread. The screw-cap closure 2 has a flat part (end face) 6 which merges into a peripheral wall 7. At the transition point there is a thread-free section 8 on the peripheral wall 7, to which section 8 there is connected an internal thread 9 corresponding to the external thread 4. A conical sealing ring 10 projects from the end face 6 into the pouring spout 3 and forms, with the mouth rim 5 thereof, a leakproof fit. In this respect, the mouth rim 5 is pressed so far outwards that it virtually bears on the thread-free section 8 but does not exert any significant pressure on it. The correct dimensioning of the thickness of the mouth rim 5 and of the conical sealing ring 10 is also important. An annular groove 11 is sunk between the peripheral wall 7 and the conical sealing ring 10, the opening 12 of which annular groove 11 is narrower than its width. An elastomeric O-ring 13 is arranged in it, against which the end face of the mouth rim 5 presses sealingly.

We claim:

1. A container comprising: a plastic body having a cylindrical pouring spout with a threaded external surface and an upper edge; a plastic closure having a top wall, a cylindrical peripheral wall depending downwardly from the top wall with a threaded internal surface configured to engage with the threaded external surface if the pouring spout, a conical sealing ring depending downwardly from the top wall and spaced radially inwardly from the peripheral wall to receive the upper edge of the pouring spout threrebetween with the external surface of the pouring spout bearing tightly on the internal surface of the peripheral wall, means forming an annular groove in the top wall between the peripheral wall and the sealing ring, the annular groove having a circular cross section with a center and a given diameter and an opening disposed symmetrically about the center and facing the upper edge of the pouring spout when engaged thereon and having a width less than the given diameter and an elastomeric O-ring in the groove and having a thickness greater than the width of the opening and engaging the upper edge of the pouring spout when the closure is engaged on the pouring spout.

2. The container according to claim 1, wherein the external surface of the pouring spout has an upper portion below the upper edge which is unthreaded and the internal surface of the peripheral wall of the closure has an upper portion which is unthreaded and wherein the upper portions bear on each other when the closure is engaged.

3. The container according to claim 1, wherein the top wall is flat and merges into the peripheral wall.

* * * * *